US006895609B2

(12) United States Patent
Ingram et al.

(10) Patent No.: US 6,895,609 B2
(45) Date of Patent: May 24, 2005

(54) ONE PIECE MOLD FOR A MULTI-PIECE TUB AND SHOWER SURROUND

(75) Inventors: Scott Ingram, Lasalle (CA); Charles M. Brown, Jackson, TN (US); Bradford Kenneth Hillam, Jackson, TN (US)

(73) Assignee: Aqua Glass Corporation, Adamsville, TN (US)

( * ) Notice: Subject to any disclaimer, the term of this patent is extended or adjusted under 35 U.S.C. 154(b) by 33 days.

(21) Appl. No.: 10/290,982

(22) Filed: Nov. 8, 2002

(65) Prior Publication Data

US 2004/0088784 A1 May 13, 2004

(51) Int. Cl.[7] ..... A47K 3/02

(52) U.S. Cl. ..... 4/538; 4/584; 4/596; 4/612; 52/35

(58) Field of Search ..... 4/538, 584, 585, 4/589, 596, 600, 612, 614, 591, 592, 593, 594, 595; 52/35, 79.1, 270, 127.1, 582.1

(56) References Cited

U.S. PATENT DOCUMENTS 4,080,710 A * 3/1978 Hess ..... 29/416
4,299,064 A * 11/1981 Daniels ..... 52/35
4,553,276 A * 11/1985 Paradis ..... 4/612
4,578,832 A * 4/1986 Primucci ..... 4/614
4,901,380 A * 2/1990 Smith ..... 4/596
5,139,833 A * 8/1992 Ohaus ..... 428/35.7
5,473,843 A * 12/1995 LaRoche et al. ..... 52/35

* cited by examiner

*Primary Examiner*—Henry Bennett
*Assistant Examiner*—Amanda R. Flynn
(74) *Attorney, Agent, or Firm*—Carlson, Gaskey & Olds

(57) ABSTRACT

A tub and shower surround assembly is initially molded as a single molded component having a waste strip which separates each individual tub and shower surround portion. The waste strip readily protects the mold and simplifies post molding operations and assures that each portion will meet final tolerances. Another waste strip is located between the tub portion and the wall portions to provide for positive draft between a tub flange which extends about the tub portion and the wall portions. Positive draft is required to assure proper removal of the mold component from the mold. The single component provides for finishing operations to be performed prior to separating the individual components. Since the majority of finishing operations are performed simultaneously prior to separating the portions, the likelihood of damage to the portions are reduced and the finish of the individual portions are of greater consistency.

19 Claims, 4 Drawing Sheets

ONE PIECE MOLD FOR A MULTI-PIECE TUB AND SHOWER SURROUND

BACKGROUND OF THE INVENTION

The present invention relates to a shower and tub surround, and more particularly to a molding process therefore.

Tub surrounds are positioned within a recess built around a bathtub or shower. The whole structure is inserted into the wall recess to form a completely waterproof surround. The fully enclosed waterproof structure is highly advantageous in that it prevents the escape of water into the wall cavity despite the shower spraying water onto the surrounding walls.

Typically, the tub and wall surrounds are molded as separate portions due to the relatively large size of each portion and the rather complex surface geometry of the tub and wall surrounds. The surround is commonly molded as a first wall surround portion, a second wall surround portion and a tub portion which are separately processed. After the mold operations, the likelihood for damage to the tub and shower surround is directly related to the number of portions in which it is molded. That is, each portion must separately transit all operations which increases the possibility for damage due to the individual components transiting the manufacturing process.

Accordingly, it is desirable to provide a tub and wall surround assembly and molding process therefor which facilitates manufacture without unnecessarily increasing the potential for damage during post molding operations.

SUMMARY OF THE INVENTION

The tub and shower surround assembly according to the present invention is initially molded as a single integral component. An area defined as a waste strip separates each individual tub and shower surround portion. The waste strip includes an outer waste strip, central waste strip and a tub waste strip. The waste strips separate the individual tub and shower surround portions.

A tub waste strip is located between the tub portion and the wall portions. The tub waste strip provides for positive draft between a tub flange which extends about the tub portion and the wall portions. The tub waste strip sets the wall portions above and to the rear of the tub flange even though the wall portions fit within the flange in the final assembled condition. Positive draft is required to assure proper removal of the mold component from the mold. Without the tub waste strip, the integral mold component would be locked onto mold.

The integral component allows finishing operations to be performed prior to separating the individual components. Since the majority of operations are performed simultaneously upon the integral component prior to separating the components, the likelihood of damage to the separate portions and the mold is reduced. Moreover, as the finishing operations are performed upon the single integral component, handling and finishing operations are simplified.

The present invention therefore facilitates manufacture without unnecessarily increasing the potential for damage due to post molding operations.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
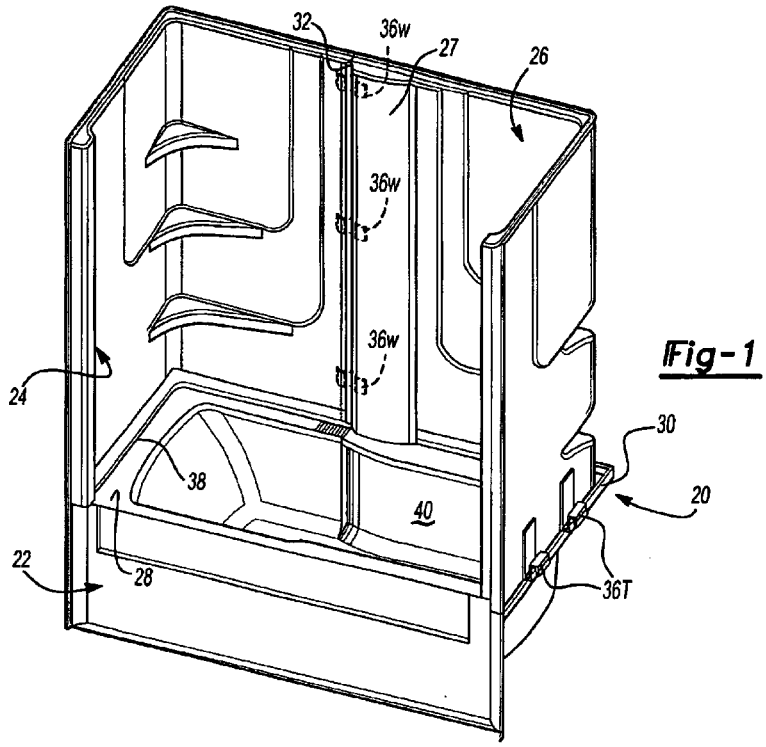
FIG. 1 is a general perspective view of a molded tub and surround according to the present invention.

FIG. 1 illustrates a general perspective view of a molded tub and surround 20 which is formed of three pieces of molded plastic. A tub portion 22 receives wall portions 24 and 26 to form the combined tub and surround 20. It should be understood that any number of wall portions will benefit from the present invention. The tub portion 22 defines a horizontal deck area 28 and a substantially vertical flange 30 extending therefore. The flange 30 preferably extends along three sides of the tub portion 22 behind the wall portions 24, 26 when in an assembled condition.

A joint 32 is defined between the wall portions 24 and 26. The wall portion 26 includes a partially arcuate portion 27 which engages wall portion 24 to define joint 32. A plurality of wall clamps 36*w* are spaced vertically along wall portion 26 to span the joint 32 and connect the wall portions 24, 26.

Figure 2:
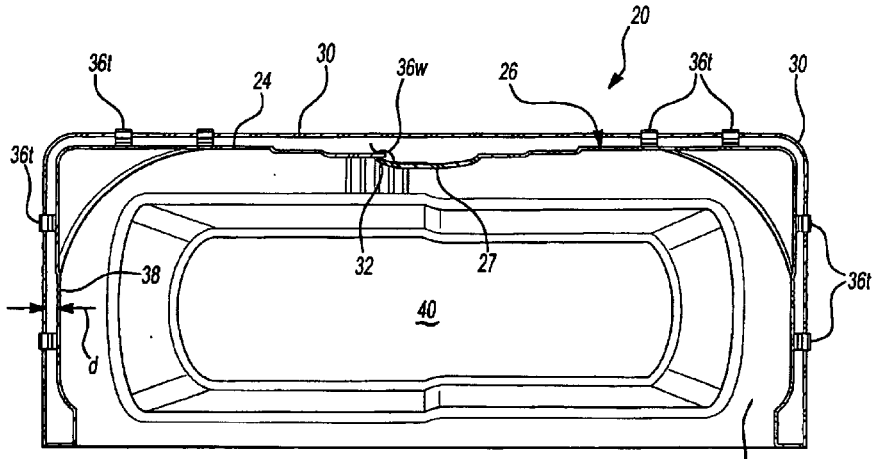
FIG. 2 is a general top view of the molded tub and surround.

A joint 38 is also defined between the wall portions 24, 26 and the deck 28 of the tub portion 22. The joint 38 is defined where the wall portions 24 and 26 meet the deck 28 between the flange 30 and the tub bowl 40 (FIG. 2). A plurality of tub clamps 36T are spaced along the flange 30 to maintain a predefined distance d between the wall portions 24 and 26 and the flange 30. That is, clamps 36T are spaced about the inner perimeter of flange 30. Clamps 36T resist pressure exerted upon the lower portion of the wall portions 24 and 26 such as, for example only, should a person push upon the wall portions 24 and 26.

Figure 3:
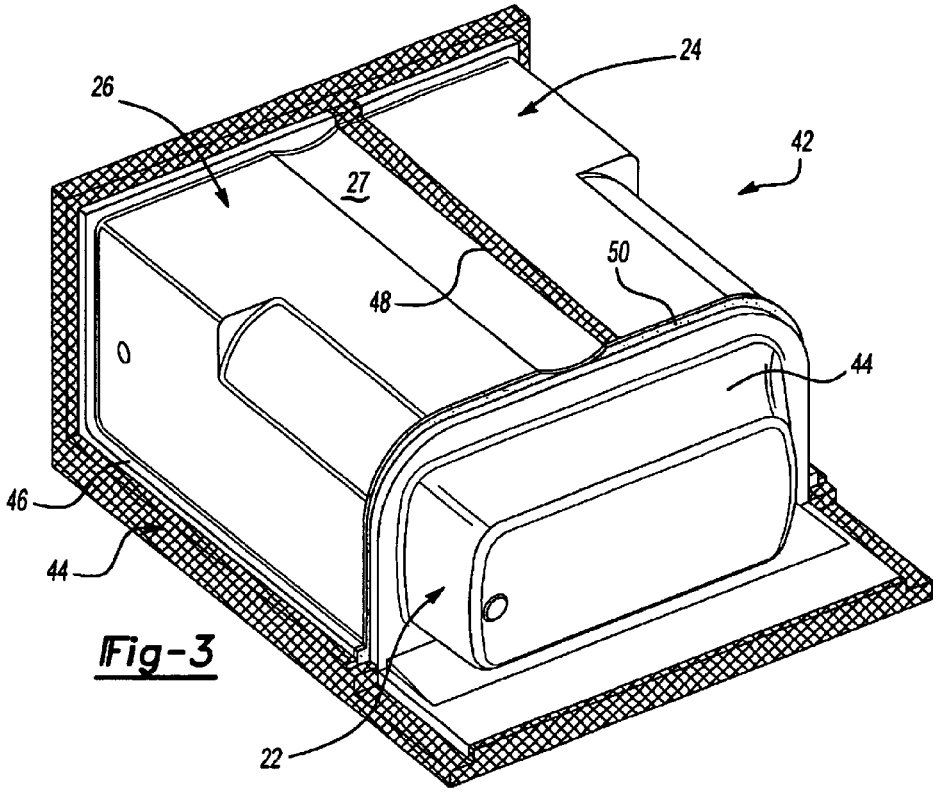
FIG. 3 is a perspective view of a single molded component which is later separated into separate tub and shower surround portions.

Referring to FIG. 3, the tub and shower surround assembly 20 is initially molded as a single molded component 42. Component 42 is molded upon a male mold 44 (FIG. 4) such that the reverse or non-visible installed side of the tub and shower surround is shown in FIG. 1. All mold operations are open-mold operations in which the tub and shower surround 20 is molded from the visible side outward.

Component 42 molds each portion 22, 24 and 26 in an orientation generally equivalent to the assembled tub and shower surround 20. That is, the tub portion 22 is located at a bottom of the molded component 42, the first wall surround portion 24 is located above the tub portion 22 and the second wall surround portion 26 is located adjacent the first wall surround portion 24. Relative terms such as "bottom" are referenced herein by the assembled condition of the tub and shower surround assembly 10 for ease of explanation and should not be considered limiting.

Figure 5:
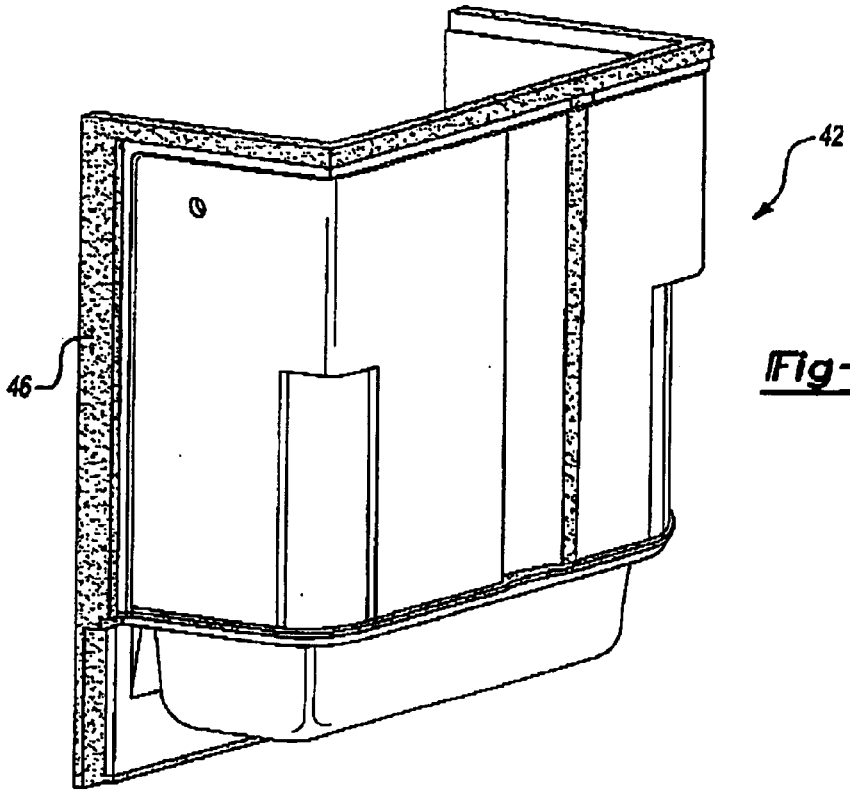
FIG. 5 is a perspective view of an integral molded tub and shower surround component prior to separation into individual components.

An area defined herein as a waste strip 44 separates each portion 22, 24 and 26. The waste strip 44 includes an outer waste strip 46 which extends from an outer periphery of each portion 22, 24 and 26. The outer waste strip 46 generally circumscribes the outer perimeter of the molded component 42 which readily protects the component 42 during post molding operation (also illustrated as the hatched area in FIG. 5). That is, outer waste strip 46 may sustain inadvertent damaged during post mold manufacture rather than portions 22, 24 or 26 or the mold 44 itself. Scrap rates are thereby readily reduced without requiring additional worker attention.

The outer waste strip 46 further serves to contain overspray. That is, as the mold 44 (FIG. 4) is sprayed with successive layers, overspray generally forms the outer waste strip 46. Outer waste strip 46 may therefore not be consistently molded to a thickness required for portions 22, 24 and 26. The lack of consistent thickness, however, is irrelevant, as the outer waste strip 46 will be removed in a post molding operation.

A wall waste strip 48 is located between wall portions 24 and 26. The wall waste strip 48 is preferably of the same thickness as the wall portions 24 and 26 to provide for tolerance variations. That is, the wall waste strip 48 may be cut to a different width to assure that the wall portions 24 and 26 are of a proper finished dimension. An joint overlap tab 38 (FIG. 6) may alternatively or additionally extend from the second wall portion 26 into the wall waste strip 48 to assist in watertight integrity during final assembly of the tub and shower surround 10.

Figure 4:
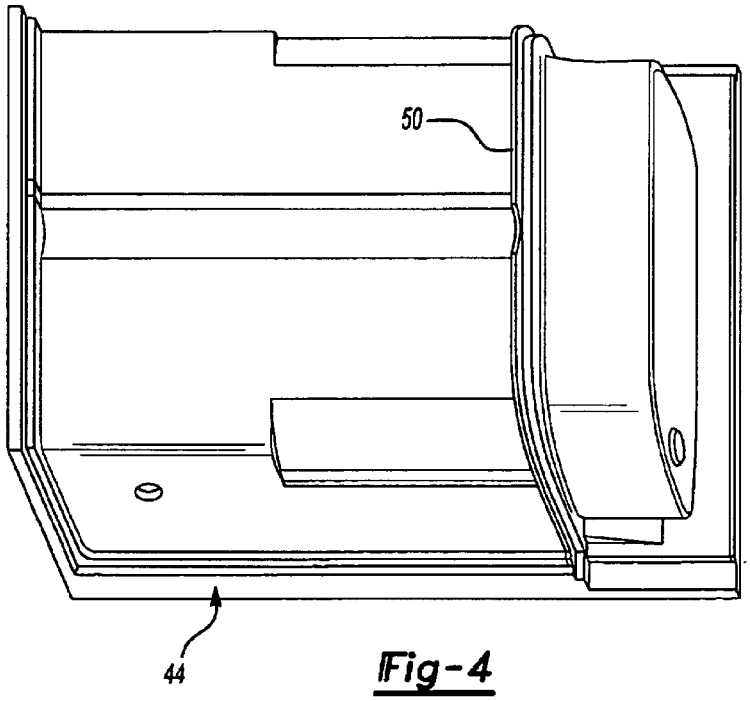
FIG. 4 is a perspective view of a mold for the single molded component of FIG. 3.

A tub waste strip 50 is located between the tub portion 22 and the wall portions 24, 26. The tub waste strip 50 is also preferably of the same thickness as the wall portions 24 and 26 to provide for tolerance variations. Moreover, tub waste strip 50 provides for positive draft between the flange 30 which extends about the tub portion 22 and the wall portions 24, 26. That Is, tub waste strip 50 sets the wall portions 24, 26 above and to the rear of the tub flange 40 (FIG. 7) even though the wall portions 24,26 fit within the flange 30 in the final assembled condition (FIGS. 1 and 2). In other words, the tub waste strip 50 forms a perimeter greater than a perimeter defined by the wall portions 24, 26 such that the wall portions 24, 26 perimeter step inwardly to the perimeter defined by the horizontal deck area 28 of the tub portion 22 (FIGS. 3, 5, 6, and 7) to form the positive draft. Positive draft is required to assure proper removal of the mold component 42 from the mold 44 (FIG. 4). Without the tub waste strip 50, the mold component would be locked onto mold 44.

Figure 8:
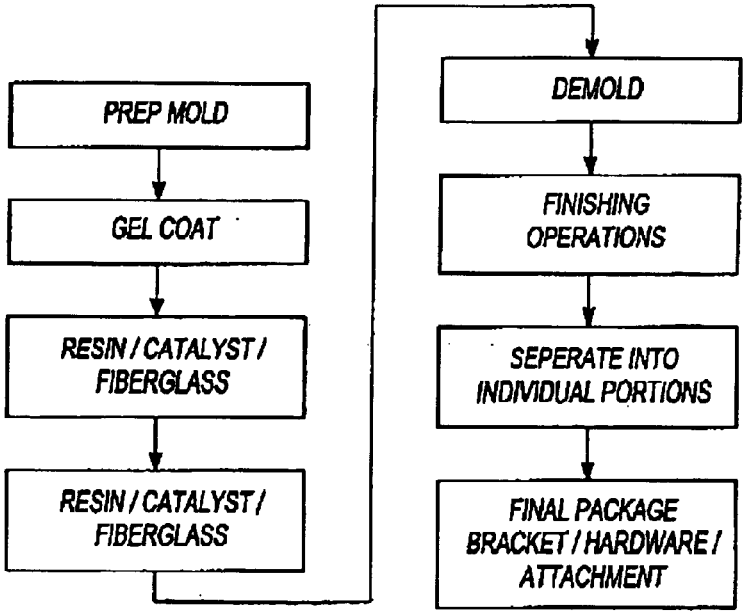
FIG. 8 is a block diagram of a method of manufacture for the molded tub and surround according to the present invention.
Figure 6:
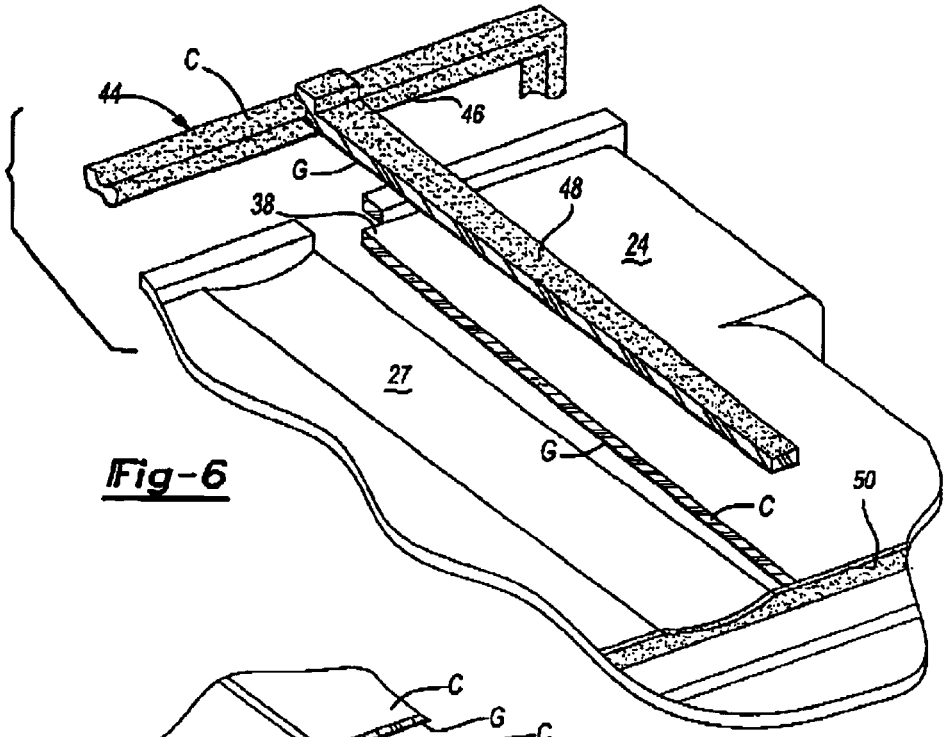
FIG. 6 is an exploded view of a waste strip of single molded component.
Figure 7:
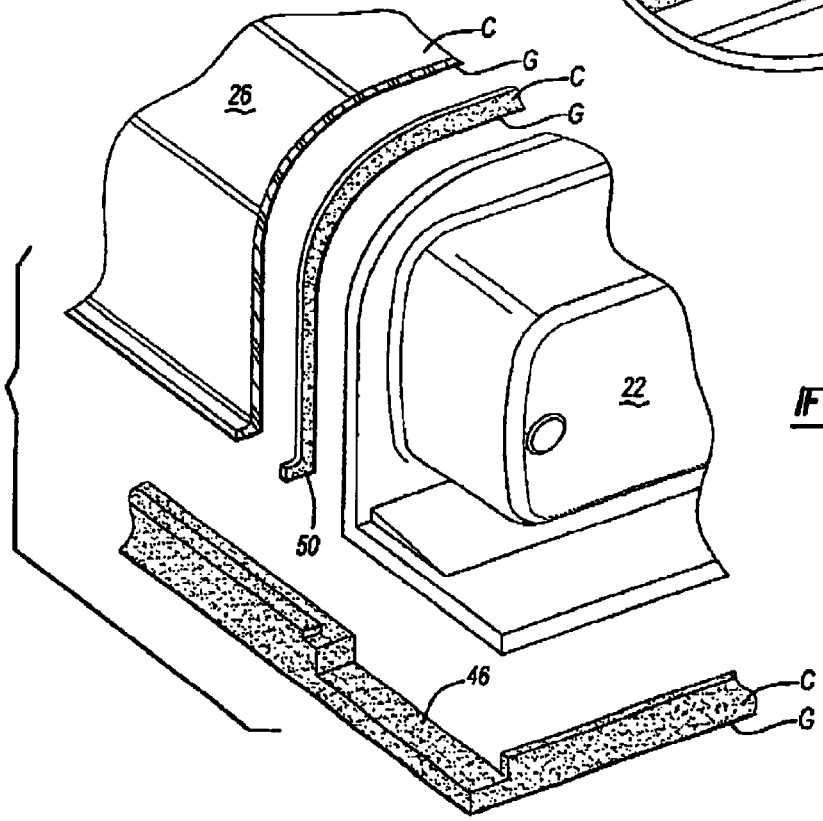
FIG. 7 is an exploded view of another waste strip.

Referring to FIG. 8, a flowchart generally illustrates the steps through which a molded tub and shower surround 20 according to the present invention is manufactured. All mold operations are open-mold operations in which the tub and shower surround 20 is molded from the visible side outward. After the mold 44 is prepped, the mold 44 is sprayed with a layer of resin referred herein as "gelcoat" G (FIGS. 6 and 7). The gelcoat, G as generally known, is a hardenable resin that becomes the visible surface of the finished product. Once the gelcoat G is applied additional resin/catalyst/chopped fiberglass mixture referred herein as "chop" C (FIGS. 6 and 7) and "one chop" are sequentially applied in successive layers to form the single molded component 42.

The component 42 is then removed from the male mold 44 such that finishing operations are performed. Preferably, the finishing operations are performed to the component 42 prior to a cutting step. After the finishing operations are performed, component 42 is cut into the separate portions 22, 24 and 26. The separated portions 22, 24 and 26 are then packaged for shipping. Since the majority of finishing operations are performed simultaneously upon component 42 the likelihood of damage to the portion 22, 24 and 26 are reduced. Moreover, as the finishing operations are performed upon the single component 42, handling and finished operations are simplified.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of open molding a tub and shower surround comprising the steps of:

(1) molding a plurality of surround portions as a single contiguous molded component with a gelcoat and a chop layer;

(2) molding a tub waste strip between a tub surround portion and a first and second wall surround portion, and a wall waste strip between the first and the second wall surround portion, the tub waste strip generally perpendicular to the wall waste strip; and (3) cutting completely through the gelcoat and chop layer of the single contiguous molded component into individual surround portions to form the wall waste strip and the tub waste strip to a particular width.

2. A method as recited in claim 1, wherein said step (2) further comprises molding the tub waste strip to form a positive draft.

3. A method as recited in claim 1, further comprising the step of molding the wall waste strip to a thickness equivalent to a thickness of the first and second wall surround portions.

4. A method as recited in claim 1, further comprising the step of:

removing the single contiguous molded component from a mold prior to said step (3).

5. A method as recited in claim 1, further comprising the steps of: removing the contiguous molded component from a mold prior to said step (3); and performing a non-mold operation after said removing step and prior to said step (3).

6. A method as recited in claim 1, wherein said step (1) further comprises:

molding an outer waste strip without concern for consistent thickness which generally circumscribes the outer perimeter of the single contiguous molded component.

7. A method as recited in claim 2, further comprises the steps of:

molding the tub waste strip to form a perimeter greater than a perimeter defined by a wall surround portion.

8. A method as recited in claim 7, further comprises the steps of:

molding the tub waste strip to form a thickness equivalent to a thickness of a wall surround portion.

9. A method as recited in claim 1, wherein said step (3) further comprises selectively cutting the waste strip to the width to assure the plurality of surround portions are of a predetermined dimension.

10. A method as recited in claim 1, wherein said step (3) further comprises selectively cutting two generally parallel cuts to form the wall waste strip to a desired width.

11. A method of open molding a tub and shower surround comprising the steps of:

(1) molding a tub surround portion and two wall surround portions as a single contiguous molded component with a gelcoat and a chop layer having an outer waste strip of a non-uniform thickness which generally circumscribes the outer perimeter of the molded component;

(2) molding a wall waste strip between the two wall surround portions generally perpendicular to the tub surround portion, the wall waste strip of a thickness consistent with the adjacent two wall surround portions; and (3) cutting completely through the gelcoat and chop layer of the single contiguous molded component into the individual tub and wall surround portions to form the wall waste strip.

12. A method as recited in claim 11, wherein said step (3) further comprises selectively cutting the wall waste strip to a desired width to assure the plurality of surround portions are of a predetermined dimension.

13. A method as recited in claim 11, further comprises the steps of:

molding a tub waste strip between the two wall surround portions and the tub portion, the tub waste strip generally perpendicular to the wall waste strip.

14. A method as recited in claim 11, further comprises the steps of:

molding the two wall surround portions to form a wall perimeter greater than a tub perimeter defined by the tub surround portion, the interface between the wall perimeter and the tub perimeter defined by a tub waste strip.

15. A method of open molding a tub and shower surround comprising the steps of:

(1) molding a plurality of tub and shower surround portions as a single contiguous molded component with a gelcoat and a chop layer;

(2) molding a waste strip between at least two of the plurality of surround portions, the waste strip of a thickness consistent with the adjacent surround portions; and (3) cutting completely through the gelcoat and chop layer of the single contiguous molded component in two generally parallel cuts to form the waste strip to a desired width to assure the plurality of surround portions are of a predetermined dimension.

16. A method as recited in claim 15, wherein said step (1) comprises:

molding an outer waste strip without concern for consistent thickness, the outer waste strip generally circumscribes the outer perimeter of the single contiguous molded component.

17. A method of open molding a tub and shower surround comprising the steps of:

(1) molding a plurality of surround portions as a single contiguous molded component with a gelcoat and a chop layer; and (2) cutting completely through the gelcoat and chop layer of the single contiguous molded component in two generally parallel cuts to form a waste strip to a selected width between two surround portions to assure the two surround portions are of a predetermined dimension.

18. A method as recited in claim 17, wherein said step (1) further comprises:

molding an outer waste strip without concern for consistent thickness, the outer waste strip generally circumscribes the outer perimeter of the single contiguous molded component.

19. A method as recited in claim 17, further comprises the steps of:

molding the waste strip to a thickness equivalent to a thickness of the wall surround portion.

* * * * *